US010711412B2

(12) United States Patent
De Valdivielso

(10) Patent No.: US 10,711,412 B2
(45) **Date of Patent: *Jul. 14, 2020**

(54) PAVER LOCKING APPARATUS AND METHOD

(71) Applicant: Noel M. De Valdivielso, Wheaton, IL (US)

(72) Inventor: Noel M. De Valdivielso, Wheaton, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/363,973

(22) Filed: Mar. 25, 2019

(65) Prior Publication Data

US 2019/0330806 A1 Oct. 31, 2019

Related U.S. Application Data

(63) Continuation of application No. 15/606,671, filed on May 26, 2017, now Pat. No. 10,240,303.

(60) Provisional application No. 62/345,210, filed on Jun. 3, 2016.

(51) Int. Cl.
*E01C 11/22* (2006.01)
*E01C 19/52* (2006.01)
*E01C 5/00* (2006.01)

(52) U.S. Cl.
CPC ..... *E01C 11/221* (2013.01); *E01C 5/003* (2013.01); *E01C 19/52* (2013.01)

(58) Field of Classification Search
CPC ..... E01C 11/221; E01C 19/52
See application file for complete search history.

(56) References Cited

U.S. PATENT DOCUMENTS 1,473,223 A * 11/1923 Gatchell ..... E01C 19/52 182/223
3,730,140 A * 5/1973 Bowser ..... A01K 1/0151 119/529
5,073,061 A * 12/1991 Jones ..... E01C 11/221 404/7
5,240,343 A * 8/1993 Strobl, Jr. ..... E01C 11/221 404/7
5,802,792 A * 9/1998 Fielding ..... E04B 2/08 52/396.08
5,993,107 A * 11/1999 Bauer ..... E01C 5/001 404/43

(Continued)

FOREIGN PATENT DOCUMENTS

GB 2142062 A * 1/1985 ..... E01C 11/221

*Primary Examiner* — Rodney Mintz
(74) *Attorney, Agent, or Firm* — John F. Rollins

(57) ABSTRACT

The present invention is directed to a paver edge restraint system for reducing shifting of a paver units making up a paved surface having one or more edge restraints installed along at least a portion of the periphery of the paved surface. The paver edge restraint system includes at least one peripheral edging member, at least one edging securement member for holding the at least one peripheral edging member to the ground, at least one paver retention strap that extends underneath a plurality of paver units constituting a portion of the paved surface, and at least one clamping unit mounted on the at least one peripheral edging member for securing and tightening the at least one strap to maintain the joint integrity of the plurality of paver units installed above and adjacent to the at least one strap.

17 Claims, 7 Drawing Sheets

(56) References Cited

U.S. PATENT DOCUMENTS

| | | | | |
|---|---|---|---|---|
| 6,071,038 | A * | 6/2000 | Strobl, Jr. | E01C 11/221 404/7 |
| 6,099,201 | A * | 8/2000 | Abbrancati | A01G 9/28 404/7 |
| 6,186,469 | B1 * | 2/2001 | Scott | B28B 19/0061 249/16 |
| 6,739,797 | B1 * | 5/2004 | Schneider | B28B 7/0029 404/35 |
| 8,915,027 | B1 * | 12/2014 | Alfieri, III | A01G 9/28 52/102 |
| 9,206,560 | B2 * | 12/2015 | Alfieri, III | E01C 5/005 |
| 9,206,561 | B2 * | 12/2015 | Alfieri, III | E01C 11/221 |
| 9,556,611 | B1 * | 1/2017 | Huckey | E04B 5/02 |
| 9,725,899 | B2 * | 8/2017 | Huckey | E04B 5/02 |
| 9,834,893 | B2 * | 12/2017 | Lynch | E01C 5/001 |
| 10,060,081 | B2 * | 8/2018 | Alfieri, III | E01C 11/221 |
| 10,240,303 | B2 * | 3/2019 | De Valdivielso | E01C 5/003 |
| 2011/0286793 | A1 * | 11/2011 | Arguello | B28B 7/162 404/35 |
| 2015/0252532 | A1 * | 9/2015 | Alfieri, III | E01C 5/005 404/37 |
| 2015/0252536 | A1 * | 9/2015 | Alfieri, III | E01C 11/221 404/7 |
| 2016/0222601 | A1 * | 8/2016 | Alfieri, III | A01G 9/28 |
| 2017/0081803 | A1 * | 3/2017 | Lynch | E01C 5/001 |
| 2017/0121970 | A1 * | 5/2017 | Huckey | E04B 5/02 |
| 2018/0355560 | A1 * | 12/2018 | De Valdivielso | E01C 5/003 |

* cited by examiner

PAVER LOCKING APPARATUS AND METHOD

PRIORITY CLAIM AND CROSS-REFERENCE TO RELATED APPLICATIONS

This application is a continuation and claims the priority benefit of U.S. application Ser. No. 15/606,671 titled PAVER LOCKING APPARATUS AND METHOD, filed on May 26, 2017, which claims the benefit of provisional application Ser. No. 62/345,210 filed on Jun. 3, 2016, the subject matter of which applications is incorporated by reference herein in its entirety.

BACKGROUND OF THE INVENTION

Field of the Invention

The present invention includes an apparatus, a system and methods for securing paver stones/bricks in driveways, sidewalks, walkways, patios and other paved surfaces to prevent displacement of the pavers after their installation. More particularly, the invention is directed to an apparatus, system and method for preserving joint integrity of the paver pattern of a paved surface over an extended period of time.

Description of the Prior Art

In the absence of an effective edge restraint, a paved side walk, driveway, patio or other paved surface will fail in a relatively short period of time. When a paved surface fails, a number of the pavers shift out of the installed pattern, the joints between some pavers open and interlock between pavers along the perimeter of the paved surface deteriorate. Even with the use of existing edge restraint systems, paving contractors are constantly being called back by their customers to fix installed paved surfaces when peripheral edge pavers have shifted over time. Once the paver joints open between pavers in one area of a paved surface, it can be difficult or impossible to limit the repair to the specific pavement section that has obviously shifted. This is because, frequently, when pavers in one part of the paved surface shift, it causes more subtle shifting and loss of joint integrity in more remote joints/pavers. The result is that large parts of the pavement often need to be replaced, rather than just the first localized area where obvious shifting was first noticed by the customer.

Most prior art paver edge restraints are fixed to the ground by edging spikes that are pounded into the ground through holes formed in the paver edge restraints. One reason that prior art edge restraint systems can be prone to failure in colder climates is that thermal expansion and contraction of the ground during repeated freeze/thaw cycles causes the edge restraint to move repeatedly up/down relative to the paved surface. This freeze/thaw cycle ground expansion/contraction can cause significant numbers of edging spikes to become loosened resulting in entire sections of the edge restraint being lifted several inches above the ground. When a sufficient number of the spikes become sufficiently loose and the edge restraint is raised sufficiently above the ground, portions of the edge restraints can laterally shift, this causes the pavers to shift out of the installed pattern so that repair is required.

One prior art attempt to provide an edge restraint system is disclosed in U.S. Pat. No. 6,099,201 issued to Abbrancati. The '201 Abbrancati patent includes a transverse belt made of a durable synthetic material such as PVC. The belt has a plurality of slots, which are dimensioned to receive stakes. The transverse belt is installed under a layer of sand in the paver sub-base. In the embodiment of the Abbrancati '201 patent shown in FIGS. 7 and 8, the free end of the belt of the Abbrancanti system is shown as being held in place by the weight of the pavers compressing the layer of sand located above the belt. The edging structure of the '201 Abbrancati patent has an exterior egg crate like structure to allow plant roots to grow through the egg crate portion of edging to help secure the edging to the ground. One of the stakes that passes through the peripheral portion of the belt also engages a front wall of the edging unit.

While the strap and edge system of the Abbrancati '201 patent may provide some level of paver joint preservation, the system is believed to be more difficult and time consuming to install than is desirable. Moreover, it is believed that the edge restraint system of the Abbrancati '201 patent is still subject to an undesirable degree of joint shifting and paver pattern degradation. Furthermore, it is believed that the system of the Abbrancati '201 patent does not adequately prevent freeze/thaw cycle loosening of edging spikes and thereby lateral movement of the edge restraints. Accordingly, Applicant has perceived a need to provide an improved apparatus, system and methods for preserving joint integrity and paver pattern integrity of a paved surface.

OBJECTS OF THE INVENTION

One object of the invention is to improve the process of preventing pavers from shifting and settling after installation in a paved surface.

Another object of the invention is to help prevent paver installation contractors from having to repair walkways, patios, driveways or other paved surfaces that have shifted when the edge restraints fail to keep them secure.

Another object of the invention is to preserve joint integrity on paved surfaces so that any necessary repairs can be localized to the area where the pavement has been damaged.

It is still another object of the invention to provide an easily installed and maintained paver edging system that ensures lateral joint integrity and paver pattern integrity for extended periods of time.

It is still another object of the invention to provide a paver edging system that allows for adjustment to the width of paver joints within an installed paved surface without removal of the pavers from the paved surface.

It is further object of the invention to provide an edge restraint system that minimizes loosening of edge restraints and edge restraint spikes during repeated freeze/thaw cycles.

It is still a further object of the invention to provide an improved method for installing an edge restraint system.

It is still a further object of the invention to provide a kit for installing a paver edging system.

SUMMARY OF THE INVENTION

In one aspect, the present invention is directed to a paver edge restraint system which provides stability from shifting for a paved surface comprised of individual paver units having one or more edge restraints installed along at least a portion of the periphery of a paved surface. The paver edge restraint system includes at least one peripheral edging unit, a plurality of edging securement members for holding the at least one peripheral edging unit to the ground, a plurality of paver retention straps that extend underneath a plurality of pavers constituting a portion of the paved surface, and at least one clamping unit mounted to the peripheral edging unit for securing and tightening at least one of the plurality of paver retention straps to maintain the joint integrity of pavers installed above and adjacent to at least one of the plurality of paver retention straps. Preferably, the system further includes a plurality of spaced apart paver retention straps which are laid underneath spaced apart sections of pavers that are installed adjacent to a plurality of peripheral edging units. The paver retention straps are preferably spaced between about two and about four feet apart along the length of peripheral edge restraints. Where the paved surface has two parallel peripheral lateral edges and opposing edge restraint units mounted thereto, each of the paver retention straps are installed between pairs of clamping units secured to the opposing edge restraint units.

In still another aspect, the invention is directed to a paver retention strap securement clamping unit for use in a paver peripheral edge restraint system, the clamping unit includes: a housing defining a clamping unit interior, the housing having a first sidewall, second side wall, front wall, back wall, and bottom wall, the back wall of housing having a substantially planar outer surface for contacting the peripheral edge restraint; a pawl arm mounted to at least one of the first sidewall and second side wall of the housing within the clamping unit interior; a ratchet wheel mounted within the clamping unit interior having teeth for engaging the pawl arm; a strap retention shaft rotatably mounted between the first sidewall and second sidewall within the clamping unit interior, the shaft includes a slot which is dimensioned to receive one end of a paver retention strap, the shaft having a terminal portion that extends beyond the housing, the terminal portion of the shaft having a lever receipt member to receive the terminal end of a clamping lever for rotating the shaft to tighten or loosen the paver retention strap; a cover for enclosing the clamping unit interior; and a clip portion extending from the back surface of the housing for securing the clamping unit to the peripheral edge restraint. Preferably, the lower portion of the back wall of the housing defines a strap entrance dimensioned to allow the strap to pass through the housing for installation on the shaft.

In still further aspect of the invention, the system of the invention includes a paver edge restraint kit including a length of elongated strap for trimming to a desired length for binding paver units in an installed paved surface as a portion of an edge restraint system. The kit also includes a plurality of clamping units each having a rotatable shaft with a slot dimensioned to receive one end of a paver retention strap material and having a lever receipt member dimension for engagement with the clamping lever to cause rotation of the shaft and thereby tightening of a strap mounted to the shaft to retain the joint integrity of the installed paved surface. The plurality of clamping units each having a securement member for mounting each of the clamping units to an edging restraint. Preferably, the clamping units of the kits of the invention further includes a ratchet wheel having teeth which are engaged by a pawl arm to retain tension in a tightened strap after installation of the pavers above the strap. The shaft is preferably rotated by the lever, which detachably mounts through one of a plurality of apertures formed in one end of strap retention shaft. The kit may optionally include a plurality of plates for mounting under the installed pavers. Each of the plurality of plates includes a slot for receipt of the paver retention strap and an aperture dimensioned for receipt of a stake for securing the plate to the subbase below the pavers. The paver retention strap material of the kit is made from a moisture resistant, biodegradation resistant, and abrasion resistant material capable of exposure to the elements for a period of years without significant degradation of its ability to retain tension on the strap after installation.

The invention is also directed to methods of installing a paver edge restraint systems including the steps of: laying a sub-base of compacted materials to support a plurality of pavers; trimming a paver retention strap material to a length slightly greater than the distance between at least one first clamping unit to be located adjacent to a first planned lateral paver edge and a second clamping unit to be located adjacent to a second planned lateral paver edge; laying the measured, trimmed paver retention strap material over the installed sub-base; installing the plurality of pavers between the first planned lateral paver edge and second planned lateral paver edge with at a portion of at least some of the pavers being installed above the measured, trimmed paver retention strap; securing the first lateral edge restraint to the ground adjacent to the first lateral paver edge; securing the second lateral edge restraint to the ground adjacent to the second lateral paver edge; securing the first clamping unit to the first lateral edge restraint; securing the second clamping unit to the second lateral edge restraint; securing a first end of the measured, trimmed paver retention strap to one of the first clamping unit and second clamping unit; securing a second end of the measured, trimmed paver retention strap to one of the first clamping unit and the second clamping unit; and tightening the trimmed, measured paver retention strap in order to cause the first clamping unit and the second clamping unit to press against the first lateral edge restraint and the second lateral edge restraint in order to maintain the desired joint integrity between the pavers.

In another aspect of the invention, an edge restraint system for use with a paved surface which abuts a building foundation or other permanent fixed structure on one or more of its peripheral sides. The edging restraint system including at least one edging restraint unit, the system comprising: a plurality of paver retention straps having a first end and second end with the second end extending underneath a plurality of pavers; a single clamping unit mounted to the first end of each of the plurality of paper restraint straps and the clamping unit being secured to at least one edge restraint unit, the clamping unit having a rotatable strap tightening member for adjusting tension in the strap; and an anchor plate for securing the second end of each of the plurality of straps under the paved surface. In one embodiment of this system of the invention, the anchor plate can be held in place by the weight of the group of pavers that cover the anchor plate. Optionally, the anchor plate may include an aperture for receipt of a spike to help to secure the anchor plate to the sub-base. In this optional embodiment of the invention, the anchor plate further includes a slot for receipt of one end of one of the plurality of paver retention straps and an aperture in the anchor plate dimensioned for receipt of a spike.

DESCRIPTION OF THE DRAWINGS

The organization and manner of the structure and function of the invention, together with the further objects and advantages thereof, may be understood by reference to the following description taken in connection with the accompanying drawings, and in which.

DETAILED DESCRIPTION

Figure 1:
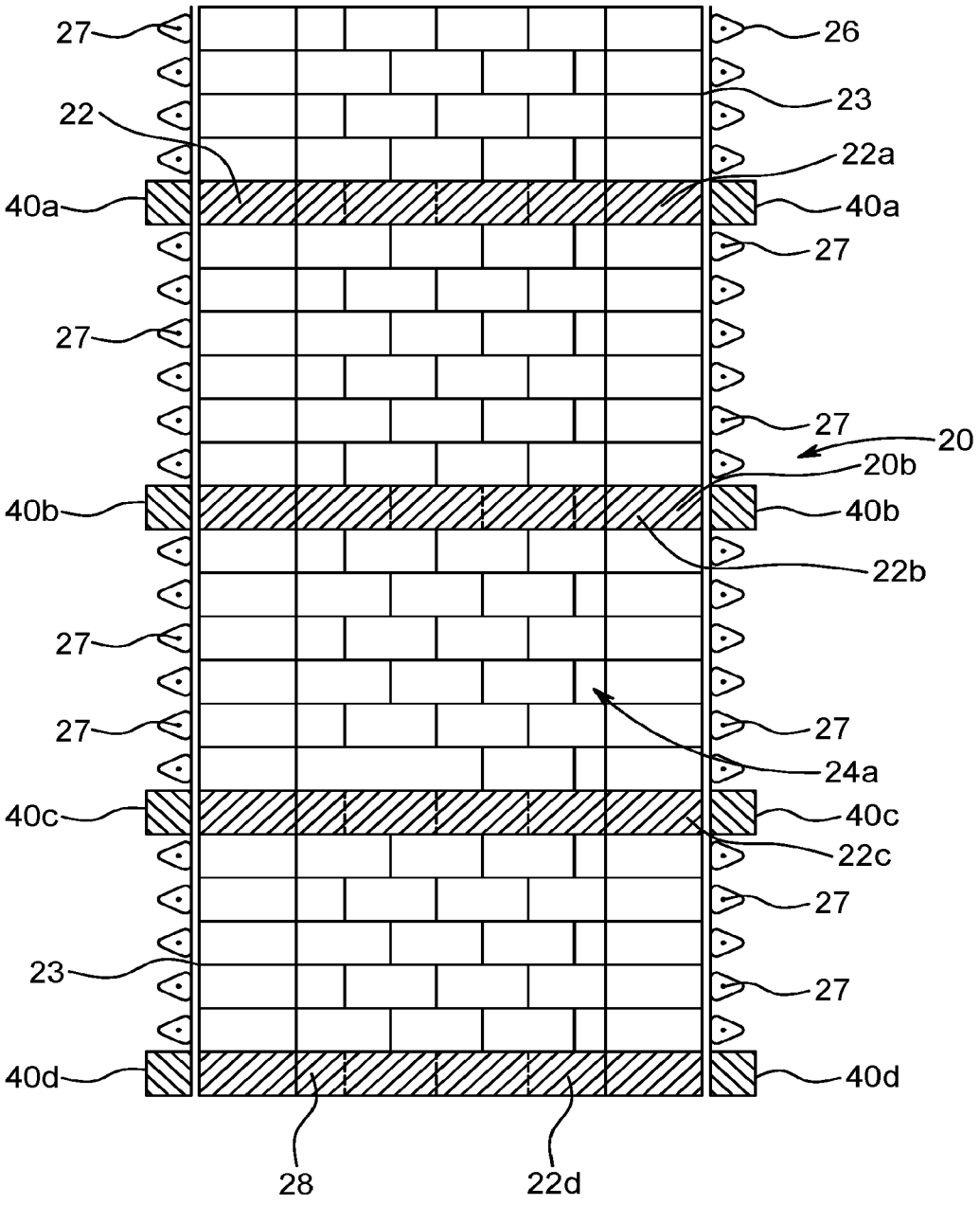
FIG. 1 is a top plan view of an edging restraint system in accordance with a first embodiment of the invention.

A first embodiment of the system of the invention is illustrated in FIGS. 1-4, the paver retention system 20 impedes paver joint shifting and maintains paver pattern integrity for a paved surface 24*a* comprised of individual pavers 28. The paved surface 24*a* has a pair of lateral edging units 26*a*, 26*b* which are secured to the ground by a plurality of spaced apart edging spikes 27. Four straps 22*a*-<1 are shown in FIG. 1 that extend underneath rows of pavers 28 between four pairs of clamping units 40*a,b*. Each of the straps 20*a-d* are laid underneath parallel rows of pavers 28 and spaced apart by about six paver edging spikes 27 which hold down the edging strips 26*a,b*. Preferably, the adjacent straps 22*a-d* are spaced apart of between about two feet and about four feet.

Once the straps 22*a-d* are installed beneath pavers, the straps 22*a-d* will be exposed to moisture, freeze thaw cycles, and may be subject to a biodegradation by mold and/or bacteria for a period of multiple years to multiple decades. The straps 22*a-d* can be made from any woven or non-woven strap material with sufficient strength, abrasion resistance, biodegradation resistance, and moisture tolerance such as, for example, a woven polyester cord, polyester composites, or woven polypropylene. The preferred paver retention strap material is a web of woven polyester material having a width between about ¾ (0.75) of an inch and about two inches provided to the paver installer on a spool (not shown) in spool lengths between 100 and 500 feet. However, paver retention strap widths as narrow as 0.5 inches in width may be used in paver installations where cost constraints are paramount. The edging units 26*a-b* are preferably made from polyvinylchloride ('PVC') and have vertical wall 23 for contacting the outer edge of the peripheral pavers 28*a-h* and a flange 25 extending from the bottom edge of the edging unit 26. The flange 25 has a plurality of apertures 29 for receipt of pave edging spikes 27.

Figure 2:
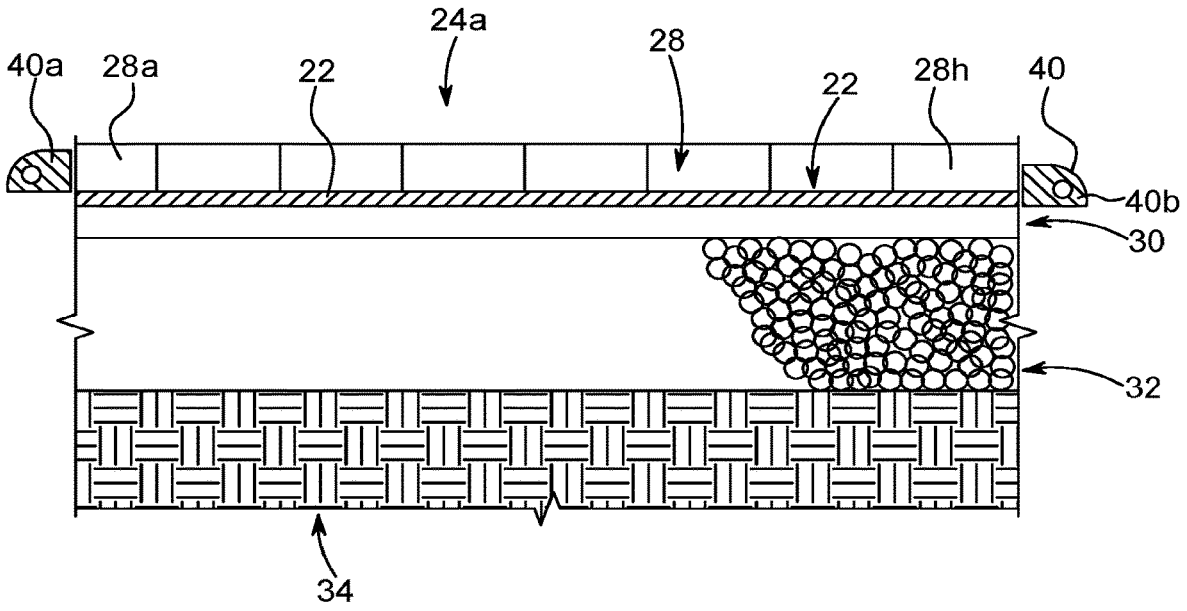
FIG. 2 is a side cross-sectional view of an edging restraint system in accordance with the embodiment of FIG. 1.
Figure 3:
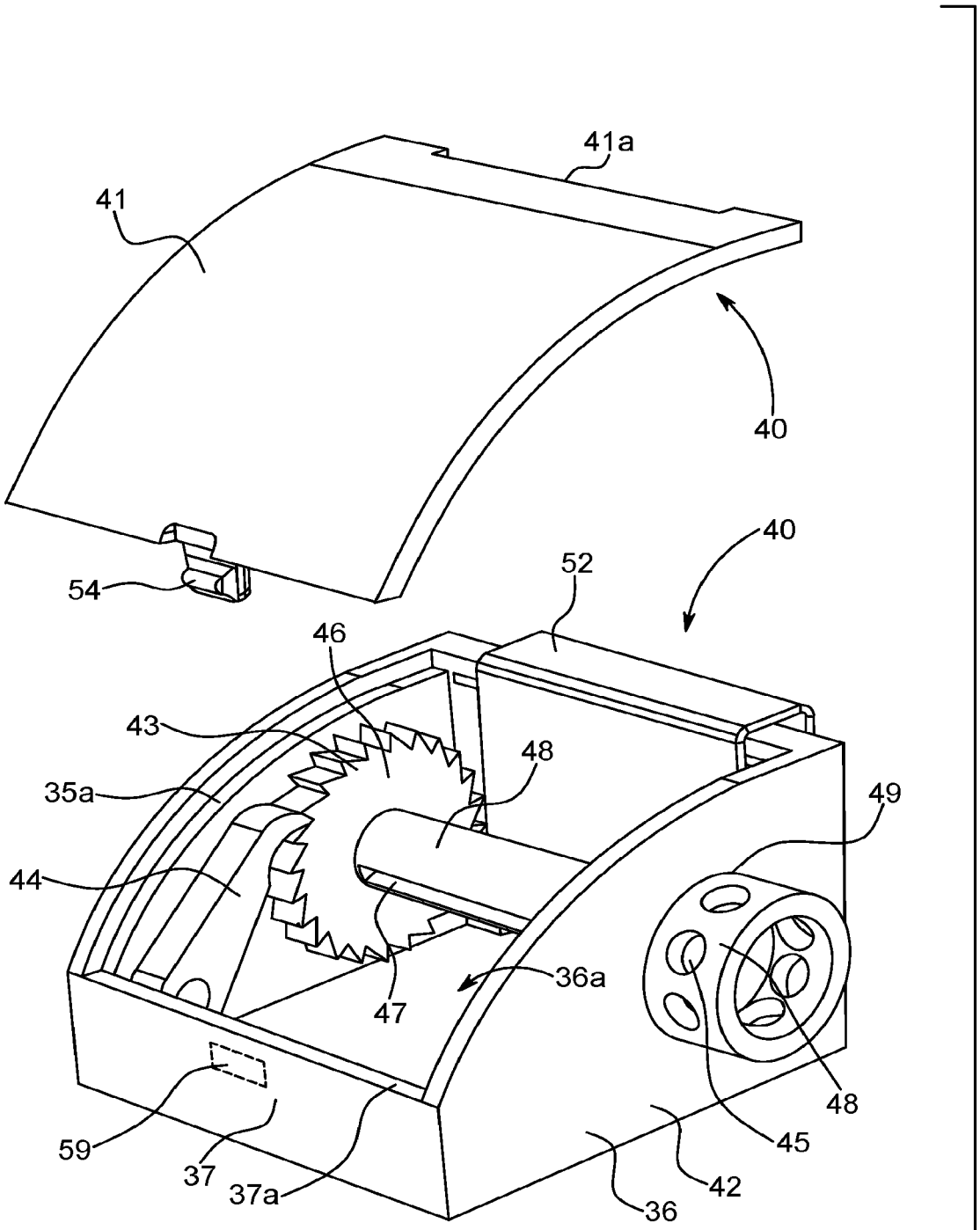
FIG. 3 is an enlarged fragmentary perspective view of a clamping unit with the cover removed in accordance with the systems the invention.
Figure 4:
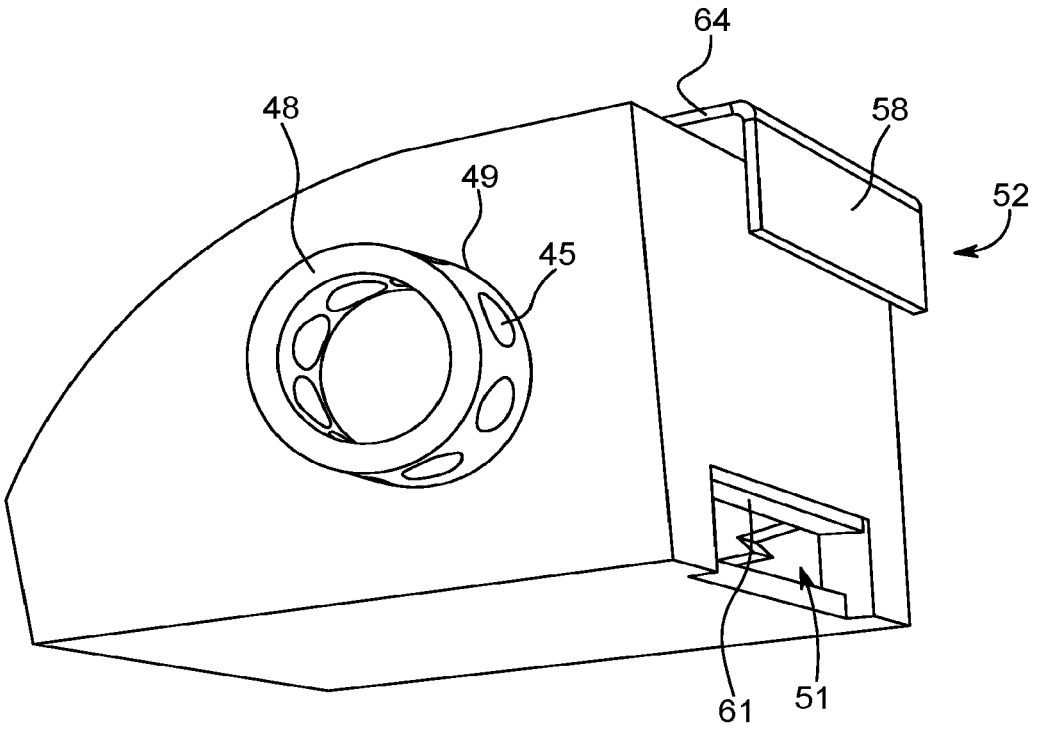
FIG. 4 is an enlarged rear perspective view of the clamping unit with the cover closed in accordance with FIG. 3.
Figure 5:
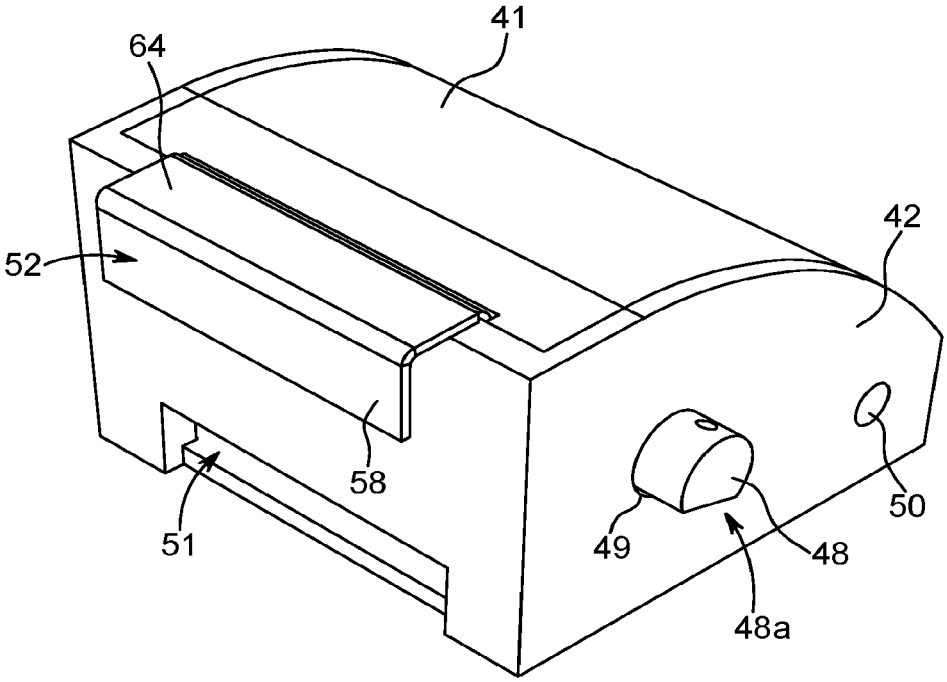
FIG. 5 is an enlarged, side perspective view of the clamping unit of the invention shown in FIG. 3.

As best seen in FIG. 2, each of the clamping units 40*a,b* bracket the edging units 26*a-b*, which in turn bracket outer edge of the perimeter pavers 28*a,h* on the end of each of the rows of pavers. The pavers 28 are installed on a conventional paver base system 33 which typically includes a course sand layer 30, compacted aggregate layer 32 and a compacted subbase layer 34. Each of the paver retention straps 22*a-b* extend between and are secured to the clamping units 40*a,b* before being tightened between the clamping units 40*a,b*.

As shown in FIGS. 4-8, the clamping unit 40 includes a cover 41, a housing 42 having an axle receipt aperture 49, a pawl arm 44 which registers against the teeth portion 43 of a ratchet wheel 46, and a shaft 48 which passes through ratchet wheel 46 and shaft aperture 49. The housing 42 has a first sidewall 35, second side wall 36, front wall 37, back wall 38, and bottom wall 39. The back wall 38 of housing 42 has a substantially planar outer surface 53 for contacting the vertical wall 23 of the peripheral edge restraint 26. The shaft 48 includes a slot 47 which is dimensioned to receive one end of the strap 22. The end portion of the shaft 48 includes a series of apertures 45 which are dimensioned to receive the terminal ends of the clamping lever 55. The clamping lever 55 rotates the shaft 48 so that the teeth 43 of the ratchet wheel 46 are engaged by pawl arm 44 to prevent the tightened paver retention strap 22 from loosening after installation of a paver retention strap 22 under the pavers 28. The shaft 48 is rotated by a clamping lever 55, which detachably mounts through the aperture 45 formed in end of axle 48. The clamping unit 40 further includes a clip member 52 for mounting the clamping unit 40 to the vertical portion of the edge restraint 26. Housing 42 further includes cover mounting ledges 35*a*, 36*a*, and 37*a* formed in first sidewall 35, second sidewall 36, and front wall 37. The cover 41 is dimensioned to rest upon cover mounting ledges 35*a*, 36*a*, and 37*a*. Cover 41 further includes a clip cut out 41*a* to accommodate entry of the clip 52 into the interior of the housing 42 and a tab 54 for securing the cover 41 to the housing at the indent 59 formed in the front wall of the housing 42. The tab 54 and indent 57 shown in FIGS. 4 through 8 are relatively small but can be strengthened by elongating both tab and indent (not shown) for paver installation situations where increased housing cover strength is deemed necessary.

Since the clamping units 40 of the systems of the invention 20 will be mounted to an edging restraint 26 that will typically be back filled with soil or gravel or other material and be exposed to the elements for multiple years, it is important that the components of the clamping unit 40 do not corrode or otherwise degrade for a period of years after their installation. For this reason and for cost efficiency, the preferred material for fabrication of the housing 42 is a polyvinyl chloride (PVC) resin, High Density Polyethylene ("HDPE") or similar plastic resins with sufficient strength, abrasion resistance, moisture resistance, and biodegradation resistance. Alternately, housing 42 of clamping unit 40 of the invention can also be fabricated from aluminum sheet stock with a gauge of between about 10 and 18. The housing 42 and cover 41 may also be fabricated from a variety of corrosion resistant metal or metal alloy sheet stock or from ferrous metal or metal alloy sheet stock coated with a corrosion resistance coatings (galvanized metals). The clamping unit cover 41 is preferably fabricated of a similar material as the housing 42 and is preferably trimmed to size utilizing a CNC cutting tool.

The shaft 48 is preferably injection molded from a strong, light plastic resin such as HDPE or PVC, but may also be fabricated from metal or metal alloy bar stocks, such as galvanized steel bar stock. Alternately, for paver installation situations where strength of the shaft is deemed to be of greater importance than minimizing cost, the shaft 48 may be cut from steel bar stock and then coated with plastic or another corrosion resistant material to prevent rust. The slot 47 and lever receipt apertures 45 are formed in the shaft 48 by either a CNC cutting tool or bar stock cutting tool, but may optionally those features may be molded into the shaft 48 by utilizing injection molding of plastic resin, or by a metal injection molding or forging process to form the shaft 48. If the shaft 48 is formed from a corrosion susceptible metal, the shaft 48 is also preferably coated with an anti-corrosion material such as zinc, zinc metal alloys, or a plastic resin after cutting process is complete. The pawl arm 44 and toothed wheel 46 may be fabricated by injection molding an HDPE or PVC resin or may also be fabricated from strong, light weight metal sheet stock and machined with a CNC cutting tool to their final dimensions and then coated with a corrosion resistant coating such as zinc, or a zinc/metal alloy. The clip member 56 may be fabricated by injection molding an HDPE or PVC resin or maybe formed from a light weight corrosion resistant metal or metal alloy sheet stock such as powder coated steel, aluminum, or galvanized steel. Since clip member 52 will be snap fit over a vertical wall 23 of an edging unit 26, the metal versions of clip member 52 are preferably fabricated from sheet stock of a resilient metal alloy such as spring steel or galvanized spring steel. The metal version clip member 52 is preferably bent into its final shape by a precision bending tool. After bending to its final shape, the metal version of clip member 52 is preferably coated with a non-corrosive coating of zinc or a zinc/metal alloy.

Figure 6:
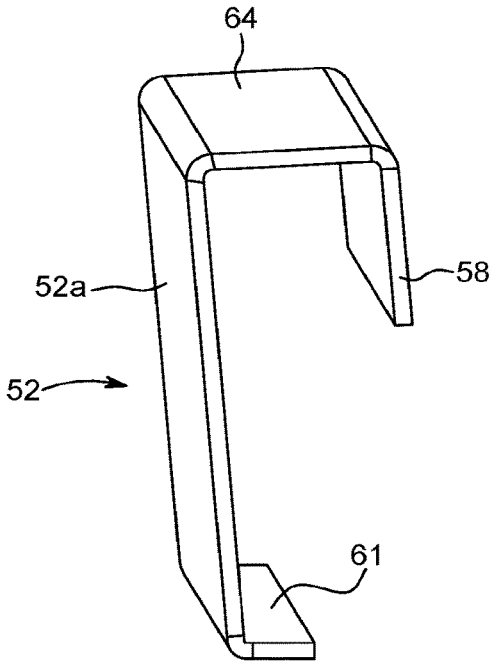
FIG. 6 is a side perspective view of a clip for use in the clamping unit of the invention shown in FIG. 3.

As can be seen in FIG. 6, the clip 52 includes an upward extending portion 52*a*, forward extending portion 64, lip portion 58 and bottom portion 61. The size and proportions of the clip 52 can be modified to fit the most commonly utilized commercial edge restraints. The inner surface of the lip portion 58 of clip 52 is dimensioned for engaging the outer surface of the vertical wall 23 of the edging unit 26. The upward extending portion 52*a* of the clip 52 is dimensioned to be slightly longer than the height of the vertical sidewall 23 of the edging unit 26. The distance between the inner surface of the lip portion 58 and the upwardly extending portion 52*a* are dimensioned to be equal to the width of the vertical wall 23 of the edging unit 26 plus the back wall 38 of the housing 42 so that, when the clamping unit 40 is inserted onto the top of the vertical wall 23, there is a friction fit between the back wall 38, vertical wall 23 and lip portion 58. This allows for the housing 42 and remainder of the clamping unit 40 to be standardized and only the size and proportions of the clip 52 changed to accommodate edging units having taller vertical walls or thicker vertical walls. To do so, the length of forward extending portion 64 can be shortened to accommodate thinner vertical sidewalls and lengthened to accommodate thicker vertical sidewalls. Similarly, the length of the upward extending portion 52*a* can be lengthened to accommodate taller, edge unit vertical sidewalls and shortened to accommodate shorter, edge unit vertical sidewalls.

After tightening of the paver retention straps 22 below the pavers 28 of the paved surface 24*a*, the clip 52 secures clamping units 40 to the edging units 26 so that the clamping units 40, tightened paver retention strap 22, and edging unit 26 all move together during a freeze/thaw cycle. This causes the pavers 28 and edging units 26 to be securely linked to each other to minimize movement of the pavers 28 relative to edging units 26 during a freeze/thaw cycle. In other words, the binding of the heavy pavers 28 by the tightened paver retention straps 22, the tight grip the clamping units 40 has on the tightened paver retention straps 22, the secure mounting of the clips 52 of the clamping units 40 to the edging units 26, and the firm engagement of the spikes 27 with the edging units 26 contributes to minimize any upward movement of the edging units 26 during freeze/thaw cycles. Furthermore, to the lesser extent that the pavers 28 and edging units 26 of the invention might move upward due to subsurface ice formation, after the subsurface ice melts, the pavers 28 will settle down to their original level due to the force provided by foot or vehicle traffic passing over the pavers 28 or due to the weight of the pavers 28 themselves. Since the edging units 26 of the system of the invention are securely linked to the pavers 28 via the clamping units 40 and paver retention straps 22, the downward movement of the pavers 28 (with their joint integrity maintained by the tightened paver retention straps 22) after a subsurface ice thaw helps to pull the edging units 26 back down into their original position.

Figure 7:
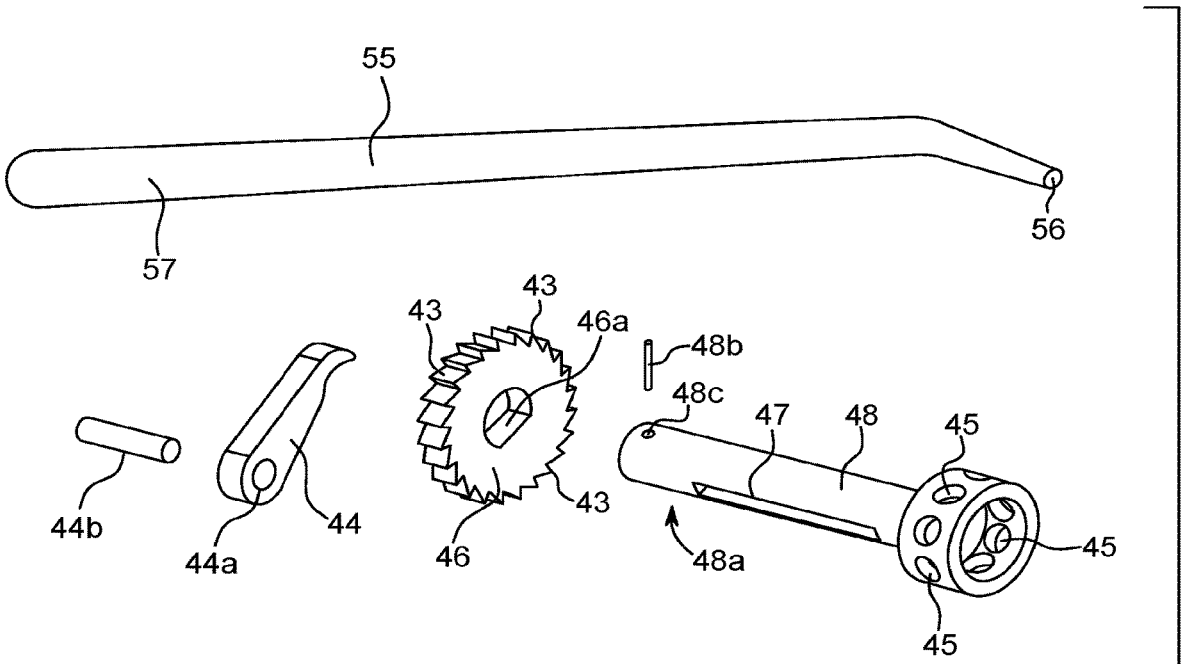
FIG. 7 is an expanded perspective view of a ratchet, pawl, and shaft of the clamping unit of the invention shown in FIG. 3.

As best illustrated in FIG. 7, to assemble a clamping unit 40, the shaft 48 is inserted through wheel 46 with the exterior flattened surface 48*a* of the shaft 48 aligned with the flattened interior surface 46*a* of the wheel 46. The ratchet arm 44 includes a pin receipt aperture 44*a* for receipt of ratchet mounting pin 44*b*. The shaft 48 is secured on one end once inserted through aperture 49 of housing 42 by cotter pin 48*b* which is inserted through pin aperture 48*c*. On the other end, the increased diameter of the lever receipt ring 45*a* engages the exterior surface of second sidewall 36 upon complete insertion of the shaft 48 through the axle receipt aperture 49. The clamping lever 55 is preferably formed from steel bar stock which is tapered on the engagement end 56. The engagement end 56 is formed with a CNC cutting tool and is preferably bent into its final configuration with a precision bending tool.

Figure 8:
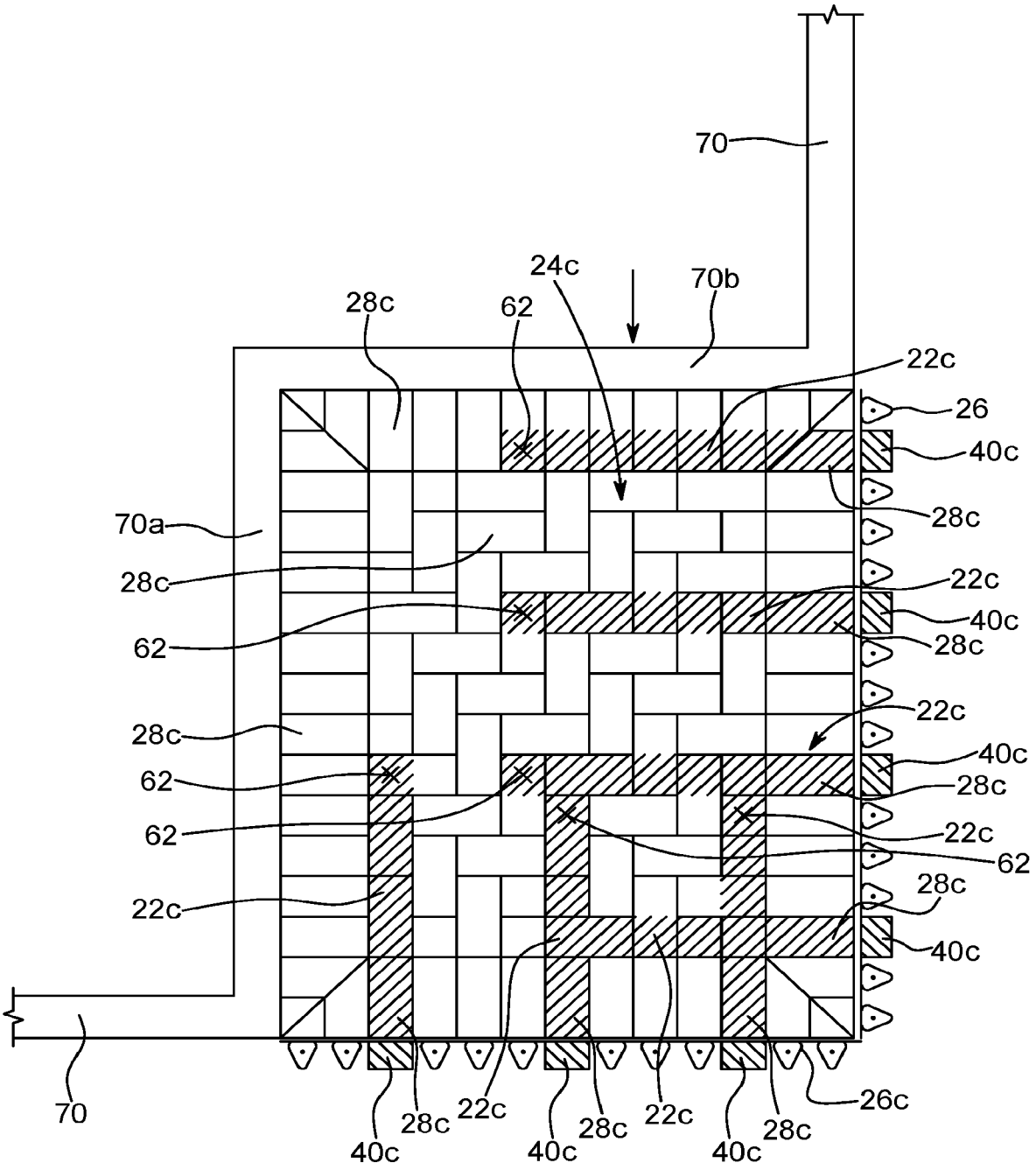
FIG. 8 is a top plan view of an edge restraint system for use abutting or building in accordance with a second embodiment of the invention.
Figure 9:
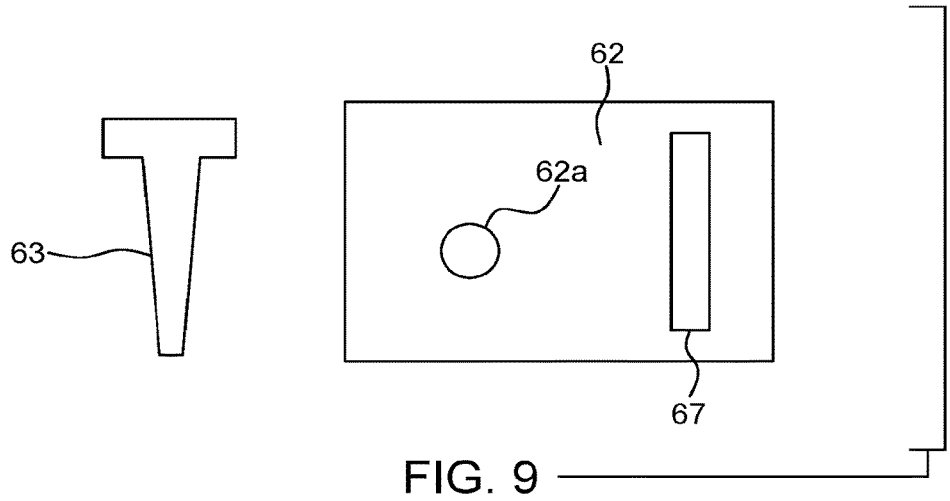
FIG. 9 is a perspective view of a spike and anchor plate in accordance with the second embodiment of the invention shown in FIG.8.

FIG. 8 shows a second embodiment of the invention for stabilizing a paved surface 60, which abuts a building foundation 70 on two of its peripheral sides. Since the two sides of the paved surface are in contact with a solid concrete foundation 70*a,b* only a single clamping unit is used per paver retention strap 22*c* which is located adjacent to the edging strips 26*c*. Accordingly, the paver retention straps 22*c* of this embodiment of the invention pass underneath the rows of pavers 28*c* and are secured on the end closest to the foundation 70*a,b* by an anchor plate 62 toward the middle of the paved surface 60. The anchor plate 62 can be held in place by the weight of the group of pavers that cover the anchor plate 62. As shown in FIG. 9, anchor plate 62 may include an aperture 62*a* for receipt of an anchor plate spike 63 to help to secure the anchor plate 62 to the paver base. The anchor plate 62 includes an anchor plate slot 67 for receipt of the one end of the paver retention strap 22*c*. The paver retention strap 22*c* is secured to the anchor plate 62 by anchor plate spike 63.

The process of installing a paver edge restraint system including the steps of laying the paver base of compacted materials to support the pavers. After the paver base 33 is installed, a paver retention strap material is measured and then trimmed to a length that matches the distance between the first clamping unit 40 and the second clamping unit 40 which are situated adjacent to the first edge restraint unit 26 and the second edge restraint unit 26. Next, the trimmed paver retention strap material is placed over the installed paver base 33 with the two ends of the paver retention strap 22 extending past the planned lateral edges of the paved surface 33. This typically means the two ends of the trimmed straps 22 extend between about 8 and about 10 inches past the lateral edges of the installed paver base 33. After the pavers 28 are installed above the trimmed paver retention strap, the first edge restraint unit 26 and second edge restraint unit 26 are secured to the ground adjacent to the paver base 33 along the lateral edges of the paved surface. The paver retention strap 22 is then secured to one of the clamping unit 40 by inserting the paver retention strap 22 through slot 47 in the shaft 48 and turning the shaft 48 until the paver retention strap 22 wraps back around onto itself. The clamping unit 40 is secured to the edge restraint units 26. The pavers 28 are then installed over the paver base 33 in between the edge restraint units 26 with a portion of the pavers 28 being installed over the paver retention strap 22. The paver retention strap 22 is tightened by inserting lever 55 in lever receipt aperture 45 and pushing or puling on the handle end 57 of lever 55 to cause shaft 48 to rotate thereby tightening the paver retention strap 22 between the first and second clamping units 40 in order to maintain the desired joint integrity.

The process of installing a paver edge restraint system with a single clamping edge unit as shown in the embodiment of the invention in FIG. 8 is similar to the process described immediately above with the exceptions discussed below. The paver retention strap material is measured and then trimmed to a length that is slightly longer than the distance between the planned location of the first clamping unit 40*c* and the planned position of the anchor plate 62. The first clamping unit 40*c* is situated laterally adjacent to the planned position of the first edge restraint unit 26*c*. Next, the measured trimmed paver retention strap material is placed over the installed paver base with the first end of the paver retention strap 22*c* extending past the planned position of the edging unit 26*c* and the second end of the paver retention strap 22*c* is attached to the anchor plate 62 by threading through the slot 67 and wrapping it around the anchor plate 62. After the pavers 28*c* are installed above the trimmed paver retention strap, the first edge restraint unit 26*c* is secured to the ground adjacent to the paver base along the edge restraint unit 26*c* of the paved surface 24*c*. The paver retention strap 22*c* is then secured to the single clamping unit 40*c* by inserting the paver retention strap 22*c* through slot 47 in the shaft 48 and turning the shaft 48 until the paver retention strap 22*c* wraps back around onto itself. The single clamping unit 40*c* is secured to the edge restraint unit 26*c*. The paver retention strap 22*c* is tightened by inserting lever 55 in lever receipt aperture 45 and pushing or puling on the handle end 57 of lever 55 to cause shaft 48 to rotate thereby tightening the paver retention strap 22*c* between the clamping unit 40*c* and the anchor plate 62 in order to maintain the desired joint integrity. Optionally, the anchor plate 62 can also be secured to the paver base 33 with the stake 63.

Figure 10:
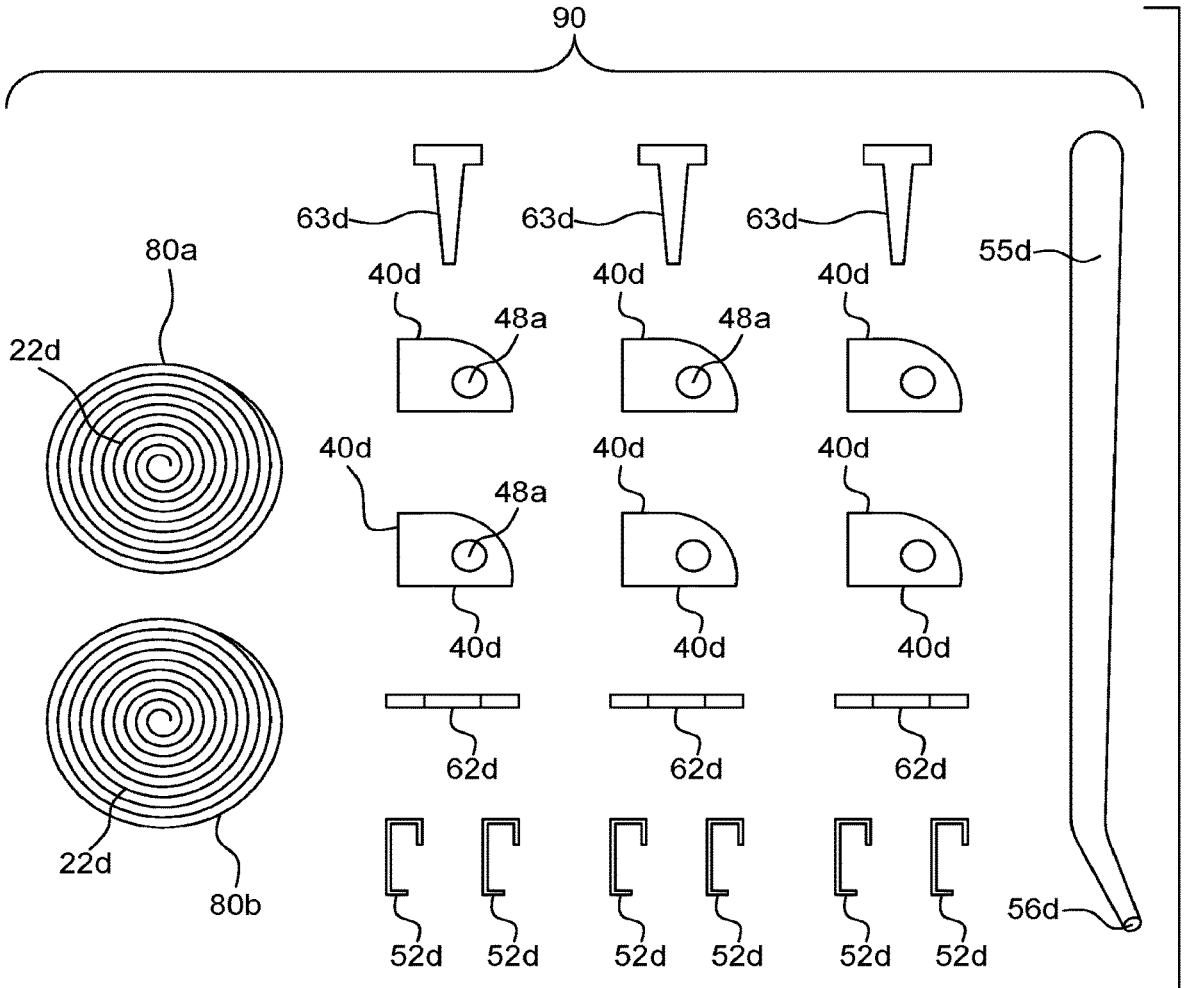
FIG. 10 is a top plan view of an edge resistant installation kit in accordance with a third embodiment of the invention.

As shown in FIG. 10, the system of the invention includes a paver edge restraint kit 90 including spools of paver retention strap material 80*a* for trimming to a desired length for binding paver units in an installed paved surface as a portion of a clamping edge restraint system. The kit 90 further includes a plurality of clamping units 40*d* each having a rotatable shaft 48 with a slot 48*a* dimensioned to receive one end of the paver retention strap material and having a lever receipt member. Optionally, the kit 90 may also include clamping lever 55*d* dimension for engagement with the clamping lever receipt member to cause rotation of the shaft 48 and thereby tightening of a paver retention strap 22*d* mounted to the shaft 48 to retain the joint integrity of the installed paved surface. Preferably, the clamping units 40*urther* ludes a ratchet wheel 46 having teeth 43 which are engaged by a pawl arm 44 to retain tension in a tightened paver retention strap 22*d* after installation of the pavers above the paver retention strap 22*d*. The shaft 48 is preferably rotated by the lever 55*d*, which detachably mounts through one of a plurality of apertures 45 formed in end of strap retention shaft 48. As shown in FIG. 10, the kit 90 may further optionally include a plurality of anchor plates 62*d* and spikes 63*d* for securing the anchor plates 62*d* to a paver base.

It is intended that the foregoing description is illustrative of the system, methods, and devices in accordance with the present invention and that the present invention be limited only by the appended claims.

What is claimed is:

1. A paver edge restraint system for reducing shifting of paver units making up a paved surface, the paver edge restraint system, comprising:

at least one peripheral edging member;

at least one edging securement member configured to hold the at least one peripheral edging member to an underlying surface;

at least one paver retention strap that extends underneath a plurality of the paver units constituting a portion of the paved surface; and at least one clamping unit engaged with the at least one peripheral edging member, the at least one clamping unit configured to secure and tighten the at least one strap to maintain joint integrity of the plurality of paver units installed above and adjacent to the at least one strap.

2. The paver edge restraint system of claim 1 wherein the at least one peripheral edging member comprises a first peripheral edging member and second peripheral edging member located on opposed peripheral edges of the paved surface, the at least one clamping unit comprises a first clamping unit mounted on the first peripheral edging member and a second clamping unit mounted on the second peripheral edging member, and the at least one strap has a first end attached to the first clamping unit and a second end attached to the second clamping unit.

3. The paver edge restraint system of claim 1 wherein the at least one clamping unit has a back wall for engaging a surface on the at least one peripheral edging member.

4. The paver edge restraint system of claim 3, wherein the at least one clamping unit has a clip portion extending from a portion of the back wall of the housing for mounting the clamping unit on the at least one peripheral edging member.

5. The paver edge restraint system of claim 1 wherein the clamping unit further comprises:

a strap retention shaft mounted on the clamping unit, the shaft retention shaft being adapted to secure first end of the at least one paver retention strap thereto.

6. The paver edge restraint system of claim 5, wherein the strap retention shaft is operably coupled to a ratchet wheel for maintaining a rotational position of the retention shaft.

7. The paver restraint system of claim 6 further comprising a pawl arm for engaging the ratchet wheel.

8. A method of installing a paver edge restraint system to maintain joint integrity between paver units making up at least a portion of a paved surface comprising the steps of:

trimming a paver restraint strap to a length that approximates a distance between a first planned lateral paver surface edge and a second planned lateral paver surface edge;

laying the paver restraint strap;

installing a plurality of pavers between the first planned lateral paver surface edge and second planned lateral paver surface edge with at least one of the pavers being installed above the measured, trimmed paver restraint strap;

securing a first lateral edge restraint to an underlying surface;

positioning a clamping unit adjacent to the first lateral edge restraint;

securing a first end of the paver restraint strap to the clamping unit;

securing a second end of the paver restraint strap to a strap receiving member; and tightening the paver restraint strap in order to maintain the joint integrity between the paver units.

9. A method of installing a paver edge restraint system to maintain joint integrity between paver units making up at least a portion of a paved surface comprising the steps of:

laying a sub-base of compacted materials;

trimming a paver restraint strap to a length that approximates a distance between at least one first clamping unit to be located adjacent to a first planned lateral paver surface edge and a strap receiving member located proximate a second planned lateral paver surface edge;

laying the measured, trimmed paver restraint strap over the installed sub-base;

installing a plurality of pavers between the first planned lateral paver surface edge and second planned lateral paver surface edge with at least one of the pavers being installed above the measured, trimmed paver restraint strap;

securing a first lateral edge restraint to an underlying surface;

positioning the first clamping unit adjacent to the first lateral edge restraint;

securing a first end of the measured, trimmed paver restraint strap to the first clamping unit;

securing a second end of the measured, trimmed paver restraint strap to the strap receiving member; and tightening the measured, trimmed paver restraint strap in order to cause the first clamping unit to press against the first lateral edge restraint in order to maintain the joint integrity between the paver units that make up the portion of the paved surface.

10. The method of claim 9, further comprising the step of engaging the first lateral edge restraint with the first clamping unit.

11. The method of claim 9, wherein the step of positioning the first clamping unit comprises securing the clamping unit to the first lateral edge restraint.

12. The method of claim 9, wherein the step of positioning the first clamping unit comprises placing a back wall of the clamping unit adjacent the first lateral edge restraint.

13. The method of claim 9, wherein the step of tightening comprises turning a ratchet wheel on the first clamping unit.

14. The method of claim 9, wherein the step of securing a second end of the measured, trimmed paver restraint strap to the strap receiving member comprises securing the second end to an anchor.

15. The method of claim 9, wherein the step of securing a second end of the measured, trimmed paver restraint strap to the strap receiving member comprises securing the second end to a second clamping unit.

16. The method of claim 9, further comprising the step of providing a paver edge restraint kit comprising:

a supply of paver strap material for trimming to a desired length for the at least one paver restraint strap; and wherein the at least one first clamping unit is a plurality of clamping units each having:

(i) a securement member for mounting a respective said clamping unit to one of the lateral edge restraints; and (ii) a rotatable shaft with a slot dimensioned to receive one end of the paver restraint strap.

17. The method of claim 16, wherein the step of providing a paver edge restraint kit further comprises providing the plurality of clamping units each having a rear wall adapted to engage one of the lateral edge restraints.

* * * * *